US012345460B2

(12) United States Patent
ahmed

(10) Patent No.: US 12,345,460 B2
(45) Date of Patent: Jul. 1, 2025

(54) PORTABLE-SMART REFRIGERATOR METHODS AND SYSTEMS

(71) Applicant: faizan ahmed, san jose, CA (US)

(72) Inventor: faizan ahmed, san jose, CA (US)

( * ) Notice: Subject to any disclaimer, the term of this patent is extended or adjusted under 35 U.S.C. 154(b) by 64 days.

(21) Appl. No.: 17/394,395

(22) Filed: Aug. 4, 2021

(65) Prior Publication Data

US 2021/0364217 A1 Nov. 25, 2021

Related U.S. Application Data

(63) Continuation-in-part of application No. 16/571,190, filed on Sep. 16, 2019, now abandoned, and a continuation-in-part of application No. 16/134,192, filed on Sep. 18, 2018, now Pat. No. 10,883,995, which is a continuation-in-part of application No. 15/939,267, filed on Mar. 28, 2018, now abandoned.

(60) Provisional application No. 62/811,523, filed on Feb. 27, 2019, provisional application No. 62/772,094, filed on Nov. 28, 2018, provisional application No. 62/477,598, filed on Mar. 28, 2017.

(51) Int. Cl.

| | |
|---|---|
| ***F25D 11/00*** | (2006.01) |
| ***F25B 21/02*** | (2006.01) |
| ***F25D 17/02*** | (2006.01) |
| ***F25D 31/00*** | (2006.01) |

(52) U.S. Cl.

CPC ..... *F25D 11/003* (2013.01); *F25B 21/02* (2013.01); *F25D 11/006* (2013.01); *F25D 17/02* (2013.01); *F25D 31/005* (2013.01)

(58) Field of Classification Search

CPC . F25D 21/02; F25D 11/00; F25D 3/10; F25D 3/08; F25D 3/107; F25D 31/002; F25D 2303/0831; F25D 2303/08; F25D 2303/0841; A47G 19/2288; A47J 41/0033; A47J 47/0038; A47J 47/0044

See application file for complete search history.

(56) References Cited

U.S. PATENT DOCUMENTS

| | | | | |
|---|---|---|---|---|
| 3,011,767 | A * | 12/1961 | Lauterbach | F25D 31/005 62/DIG. 7 |
| 5,636,522 | A * | 6/1997 | Ramos | A47G 19/2227 62/294 |
| 2004/0074250 | A1* | 4/2004 | Junkins | F25D 3/02 62/259.3 |
| 2012/0312031 | A1* | 12/2012 | Olsen | A47J 41/02 220/592.27 |
| 2016/0192797 | A1* | 7/2016 | Yang | B65D 53/02 220/592.17 |
| 2017/0336134 | A1* | 11/2017 | Williams | F25D 11/006 |

(Continued)

*Primary Examiner* — Elizabeth J Martin

(57) ABSTRACT

In one aspect, a portable-smart refrigerator includes a PCM chamber assembly. The portable-smart refrigerator includes a cooling-coil assembly comprising a feeding tube, a top elbow, a bottom tube, a cooling coil. The top elbow is installed between two lengths of tubing/pipe to enable a change of direction and couples the feeding tube with the cooling coil. The cooling coil is coupled with the bottom tube. The phase change material (PCM) chamber assembly that holds the cooling coil. The PCM chamber is placed within an outer cylinder. A bottom portion of the PCM chamber assembly is coupled with the grill assembly. A thermo-electric cooler pump comprising a liquid pump with an integrated chiller and an integrated heater.

1 Claim, 24 Drawing Sheets

(56) References Cited

U.S. PATENT DOCUMENTS

| | | | | |
|---|---|---|---|---|
| 2019/0357711 | A1* | 11/2019 | Nichols | B65D 47/142 |
| 2020/0060476 | A1* | 2/2020 | Perentes | A47J 31/4492 |
| 2022/0174943 | A1* | 6/2022 | Skiba | A01N 1/0252 |

* cited by examiner

PORTABLE-SMART REFRIGERATOR METHODS AND SYSTEMS

CLAIM OF PRIORITY

This application claims priority to and incorporates by reference U.S. application Ser. No. 16/571,190, titled PORTABLE-SMART REFRIGERATOR METHODS AND SYSTEMS, and filed on 16 Sep. 2019.

U.S. application Ser. No. 16/571,190 claims priority to and incorporates by reference U.S. Provisional Application No. 62/772,094, titled THERMO-ELECTRIC COOLER PUMP METHODS AND SYSTEMS, and filed on 28 Nov. 2018.

U.S. application Ser. No. 16/571,190 claims priority to and incorporates by reference U.S. Provisional Application No. 62/811,523, titled PORTABLE-SMART REFRIGERATOR METHODS AND SYSTEMS, and filed on 27 Feb. 2019.

U.S. application Ser. No. 16/571,190 claims priority to U.S. patent application Ser. No. 16/134,192 filed on Sep. 18, 2018. U.S. patent application Ser. No. 16/134,192 claims priority to U.S. patent application Ser. No. 15/939,267 filed on Mar. 28, 2018. U.S. patent application Ser. No. 15/939,267 claims priority to U.S. provisional patent application No. 62/477,598 filed on 28 Mar. 2017. These patent applications are hereby incorporated by reference in their entirety.

BACKGROUND

Field of the Invention

The invention is in the field of refrigeration and more specifically to a method, system and apparatus of a portable-smart refrigerator.

Description of the Related Art

Medicines and other products can degrade in certain conditions. For example, some temperatures need to be maintained in specified temperature ranges. Patients may not be able to constantly track medicine temperature. The same can be true for some testing instruments such as blood testing strips. Portable refrigerators can solve these issues. However, effective portable refrigerators need effective components that are sufficient. Accordingly, improvements to thermo-electric cooler pump design and use are desired.

BRIEF SUMMARY OF THE INVENTION

In one aspect, a portable-smart refrigerator includes a PCM chamber assembly. The portable-smart refrigerator includes a cooling-coil assembly comprising a feeding tube, a top elbow, a bottom tube, a cooling coil. The top elbow is installed between two lengths of tubing/pipe to enable a change of direction and couples the feeding tube with the cooling coil. The cooling coil is coupled with the bottom tube. The phase change material (PCM) chamber assembly that holds the cooling coil. The PCM chamber is placed within an outer cylinder. A bottom portion of the PCM chamber assembly is coupled with the grill assembly. A thermo-electric cooler pump comprising a liquid pump with an integrated chiller and an integrated heater.

Figure 1:
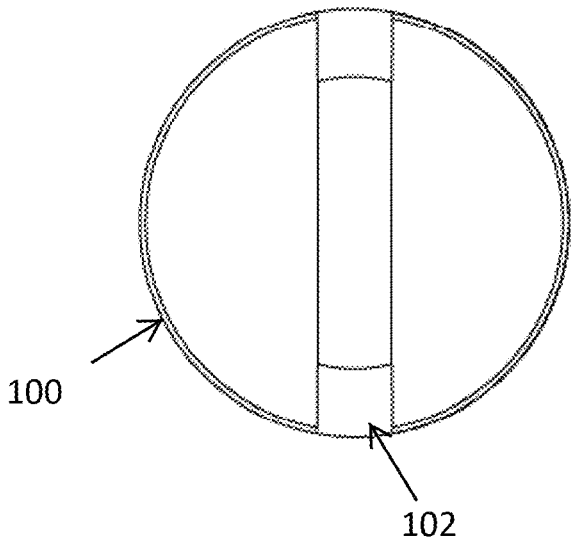
FIG. 1 is a top view of the portable-smart refrigerator, according to some embodiments.

The Figures described above are a representative set and are not an exhaustive with respect to embodying the invention.

DESCRIPTION

Disclosed are a system, method, and article of manufacture for a portable-smart refrigerator. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment, according to some embodiments. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Acrylonitrile butadiene styrene (ABS) is a common plastic polymer.

High-density polyethylene (HDPE) or polyethylene high-density (PEHD) is a polyethylene thermoplastic made from petroleum.

Peltier effect is the presence of heating or cooling at an electrified junction of two different conductors. When a current is made to flow through a junction between two conductors, A and B, heat may be generated or removed at the junction. Thermoelectric cooling uses the Peltier effect to create a heat flux between the junction of two different types of materials. A Peltier cooler, heater, or thermoelectric heat pump is a solid-state active heat pump which transfers heat from one side of the device to the other, with consumption of electrical energy, depending on the direction of the current.

Phase change material (PCM) is a substance with a high heat of fusion which, melting and solidifying at a certain temperature, is capable of storing and releasing large amounts of energy. Heat is absorbed or released when the material changes from solid to liquid and vice versa.

Polypropylene (PP) is a thermoplastic polymer used in a wide variety of applications. It is produced via chain-growth polymerization from the monomer propylene.

Press fit or friction fit is a fastening between two parts which is achieved by friction after the parts are pushed together, rather than by any other means of fastening.

Temperature sensors can include mechanical temperature sensors, electrical temperature sensors, integrated circuit sensors, medometers, etc.

Thermoelectric effect is the direct conversion of temperature differences to electric voltage and vice versa via a thermocouple. A thermoelectric device creates voltage when there is a different temperature on each side. Conversely, when a voltage is applied to it, heat is transferred from one side to the other, creating a temperature difference. At the atomic scale, an applied temperature gradient causes charge carriers in the material to diffuse from the hot side to the cold side.

Example Smart Refrigerator Exterior Views

Figure 2:
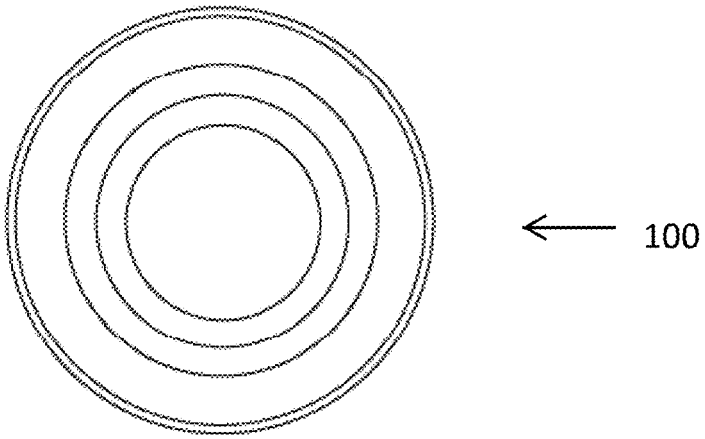
FIG. 2 is bottom view of the portable-smart refrigerator, according to some embodiments.
Figure 3:
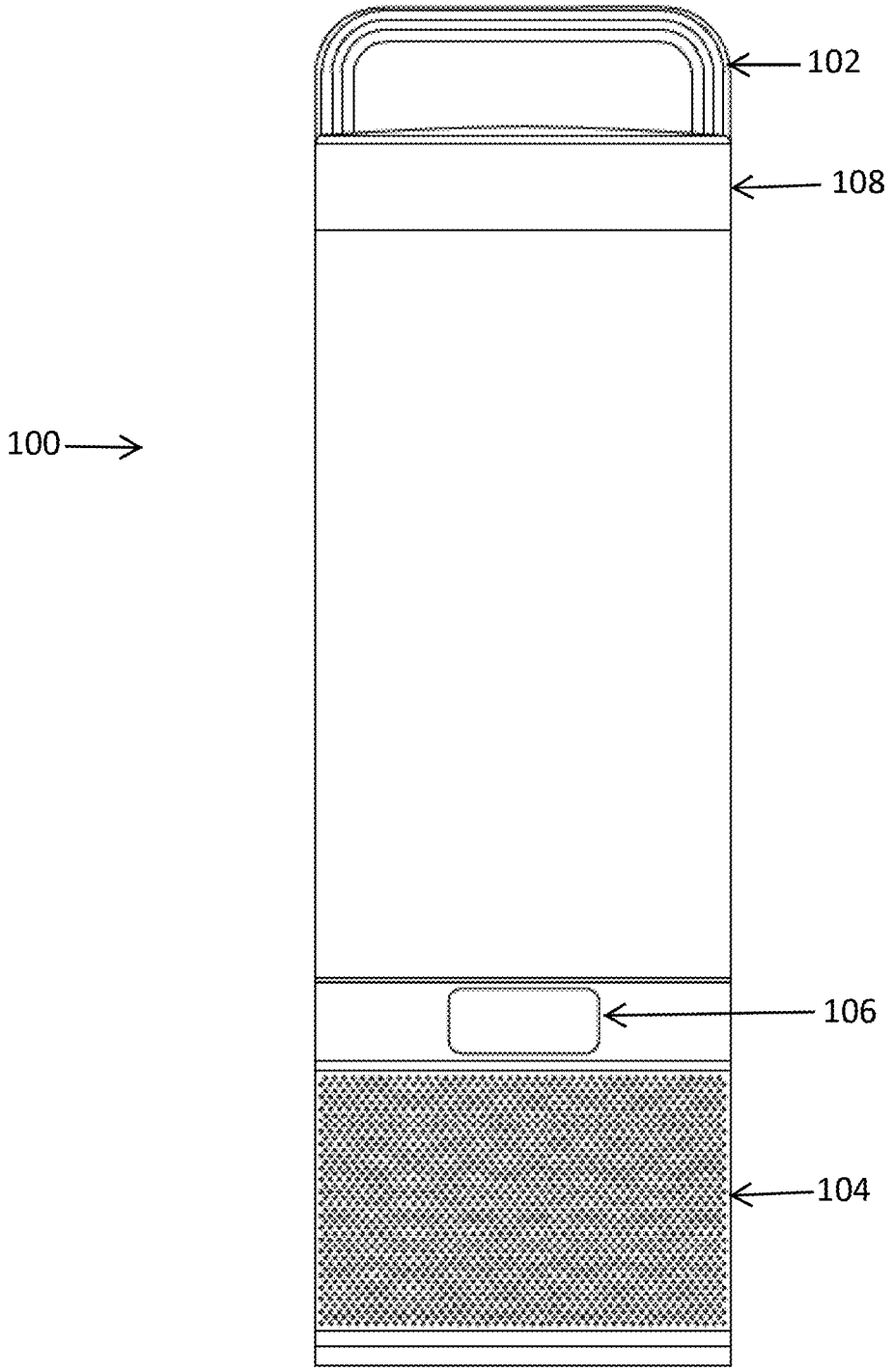
FIG. 3 is a front view of the portable-smart refrigerator, according to some embodiments.
Figure 4:
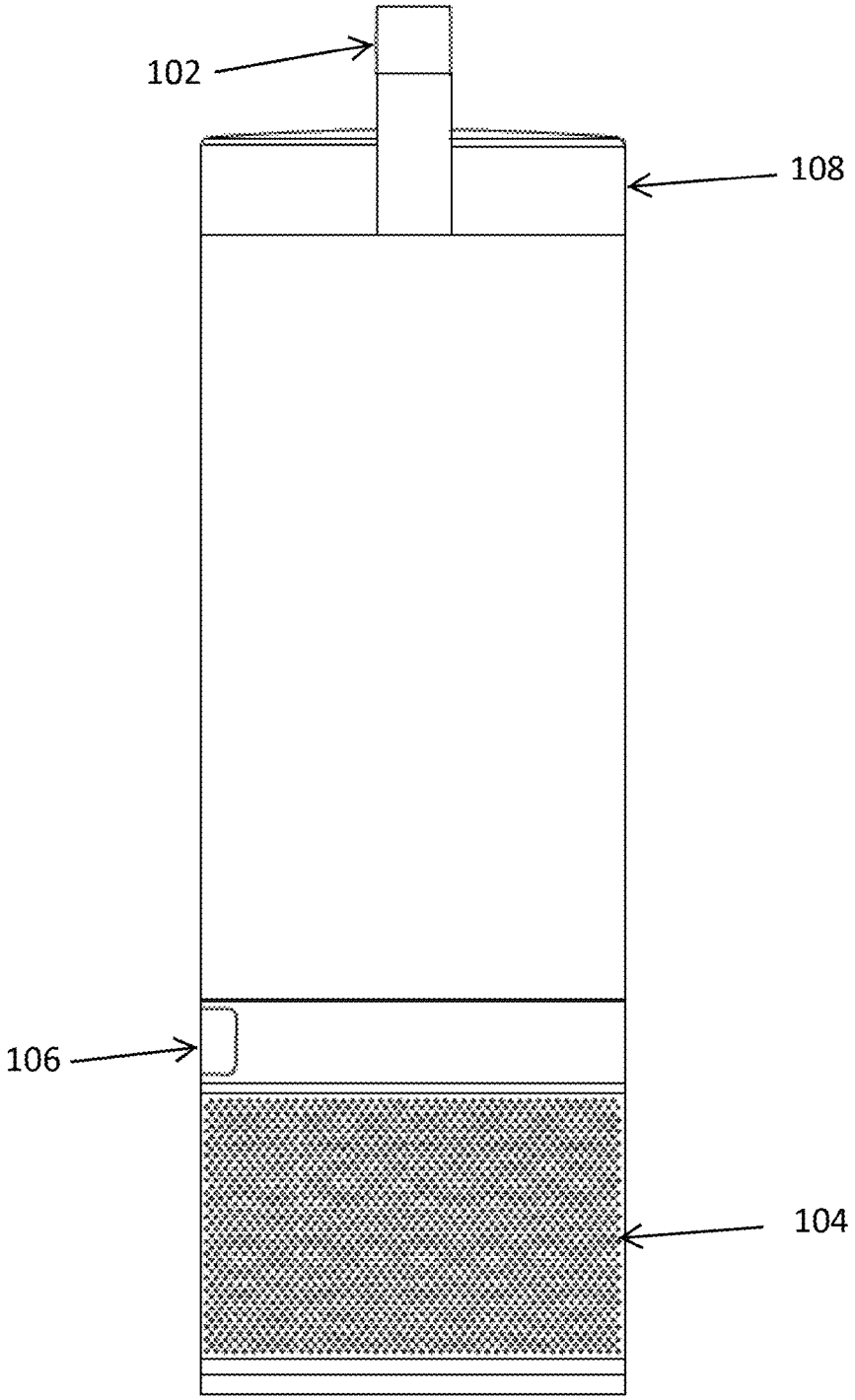
FIG. 4 is a side view of the portable-smart refrigerator, according to some embodiments.
Figure 5:
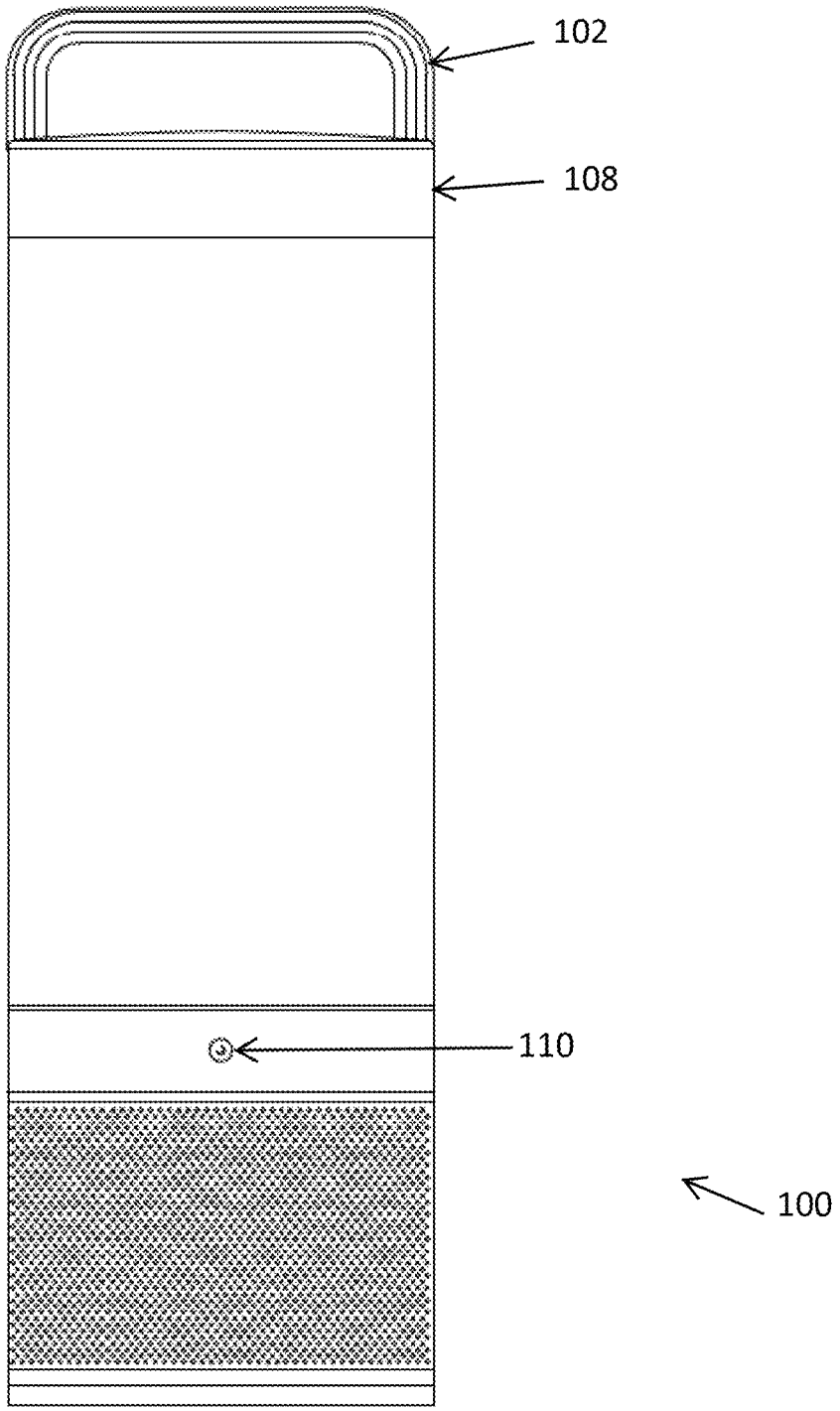
FIG. 5 is a back view of the portable-smart refrigerator, according to some embodiments.
Figure 6:
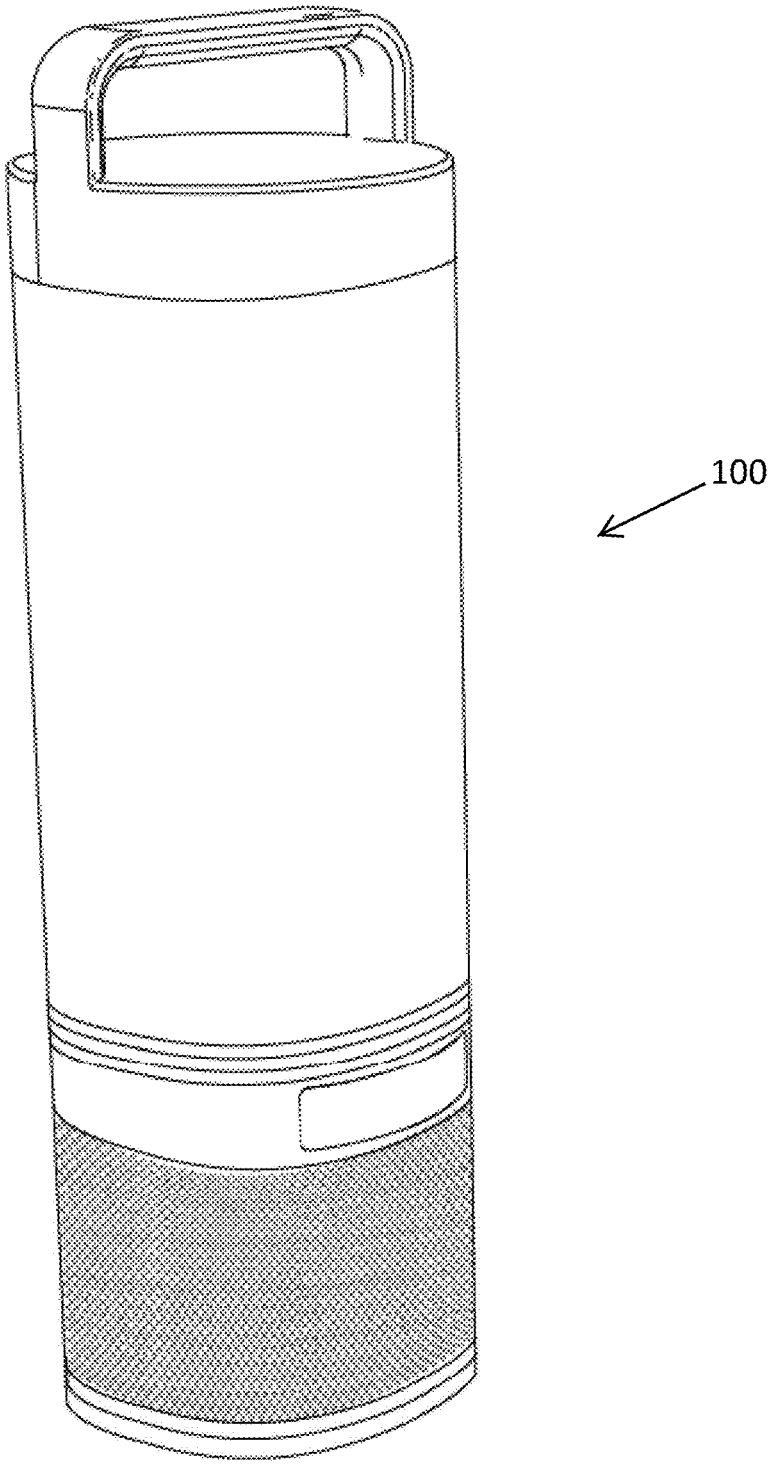
FIG. 6 is a perspective view of the portable-smart refrigerator, according to some embodiments.

FIG. 1 is a top view of the portable-smart refrigerator 100, according to some embodiments. The lid 108 of portable-smart refrigerator 100 includes a handle 102. FIG. 2 is bottom view of the portable-smart refrigerator, according to some embodiments. FIG. 3 is a front view of the portable-smart refrigerator, according to some embodiments. Portable-smart refrigerator 100 includes an exterior user display/interface 106. Portable-smart refrigerator 100 includes a grill exterior 104. Grill exterior 104 can enable the inflow of air and/or outflow of heat to and from various interior systems portable-smart refrigerator 100. FIG. 4 is a side view of the portable-smart refrigerator, according to some embodiments. FIG. 5 is a back view of the portable-smart refrigerator, according to some embodiments. FIG. 6 is a perspective view of the portable-smart refrigerator, according to some embodiments.

Example Smart Refrigerator Assembly

Figure 7:
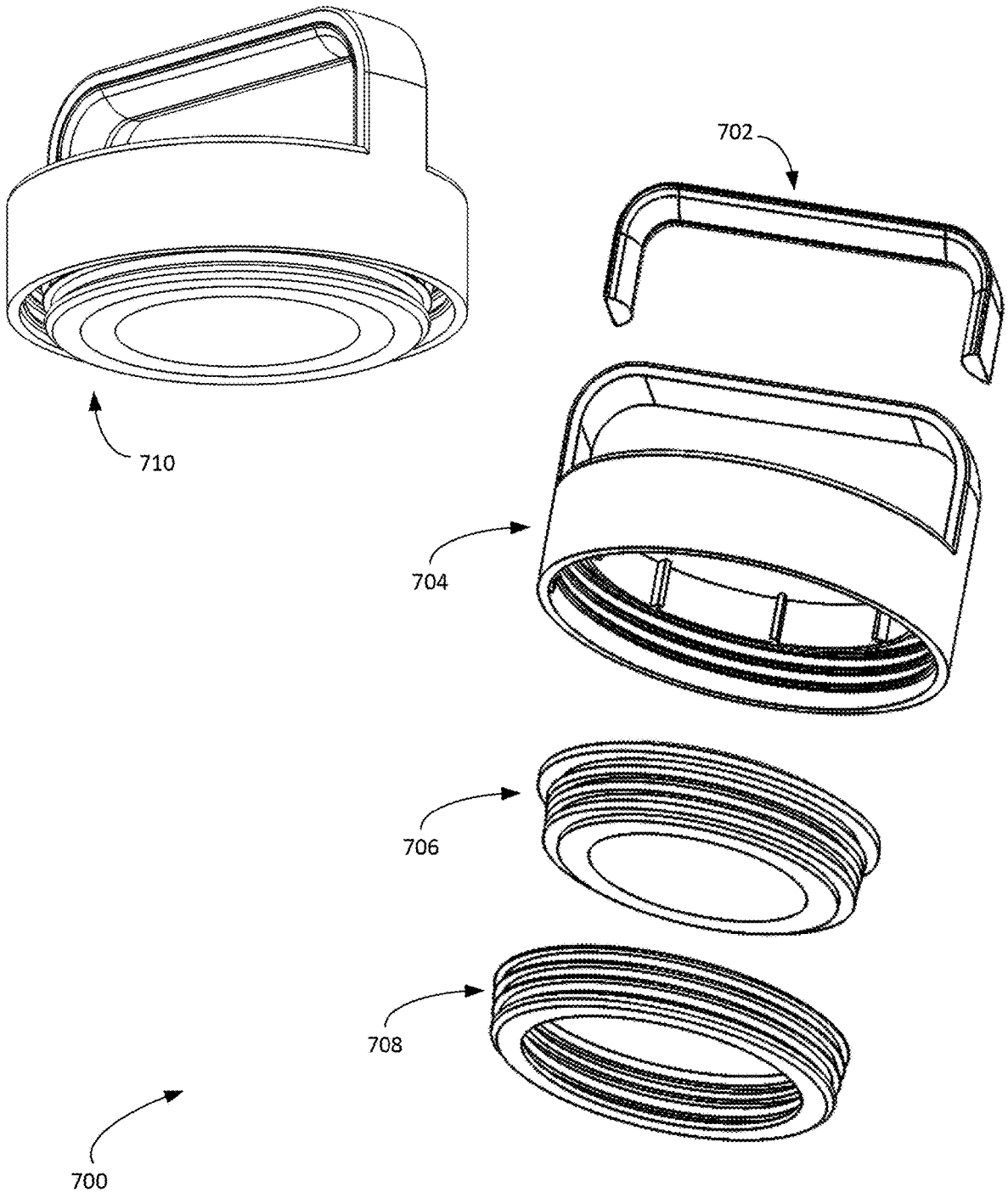
FIG. 7 illustrates an exploded view of an example portable-smart refrigerator lid assembly, according to some embodiments.

FIG. 7 illustrates an exploded view of an example portable-smart refrigerator lid assembly 700, according to some embodiments. Portable-smart refrigerator lid assembly 700 can be utilized to form lid 108 discussed supra. Portable-smart refrigerator lid assembly 700 includes handle 702. Handle 702 can be a lid over mold made of ABS. Portable-smart refrigerator lid assembly 700 includes lid 704. Handle 702 is connected with lid 704 as shown. Lid 704 can be a mold made of ABS. Portable-smart refrigerator lid assembly 700 includes lid bottom cover 706. Lid bottom cover 706 is coupled with the lid silicone seal 708. Lid bottom cover 706 and lid silicone seal 708 have a helical ridge (a male thread) for fastening portable-smart refrigerator lid assembly 700 to an internal upper portion of portable-smart refrigerator 100 with a corresponding female thread (not shown). An assembled version 710 of portable-smart refrigerator lid assembly 700 is also shown.

Figure 8:
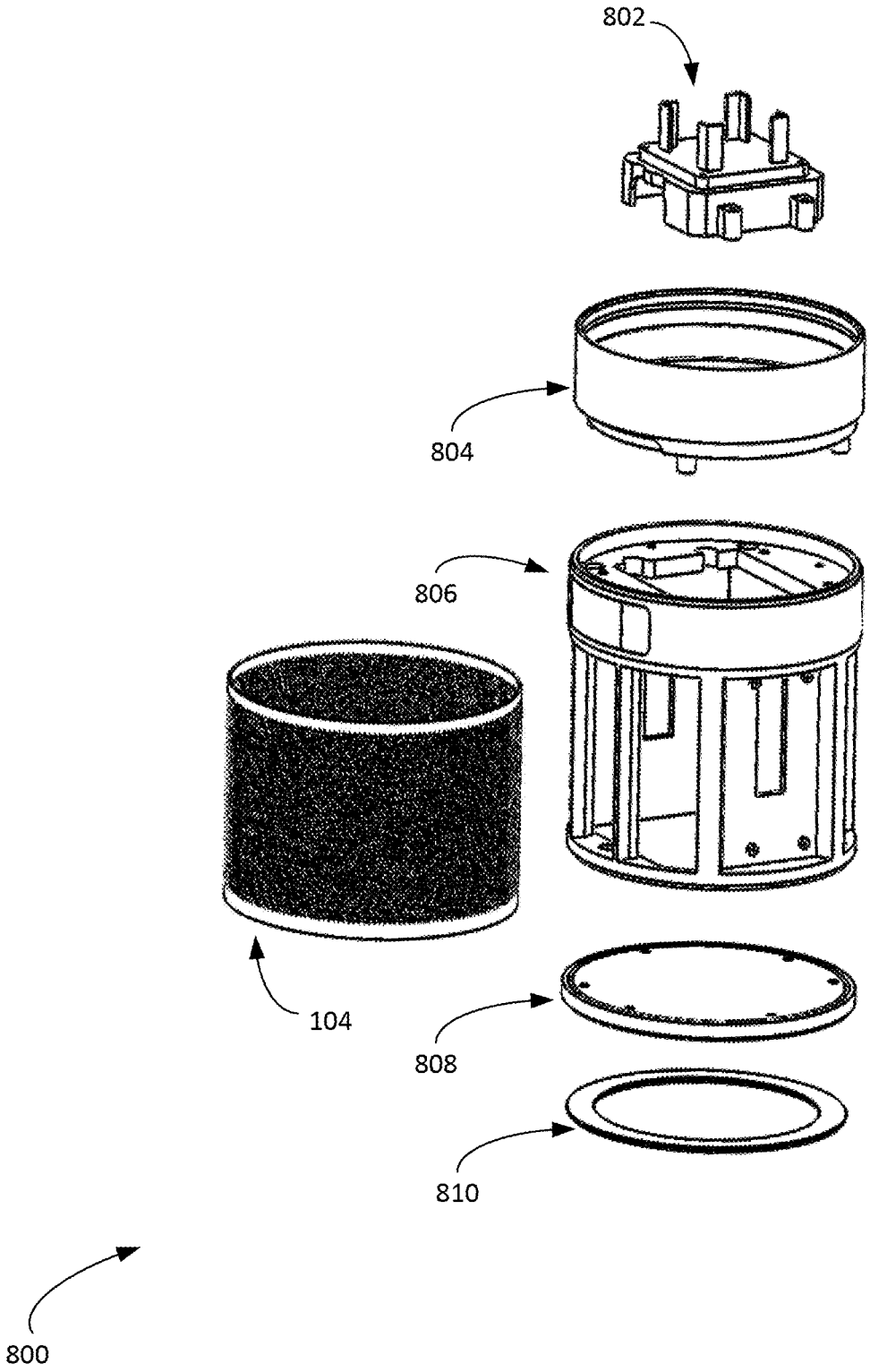
FIG. 8 illustrates an example portable-smart refrigerator grill assembly, according to some embodiments.
Figure 9:
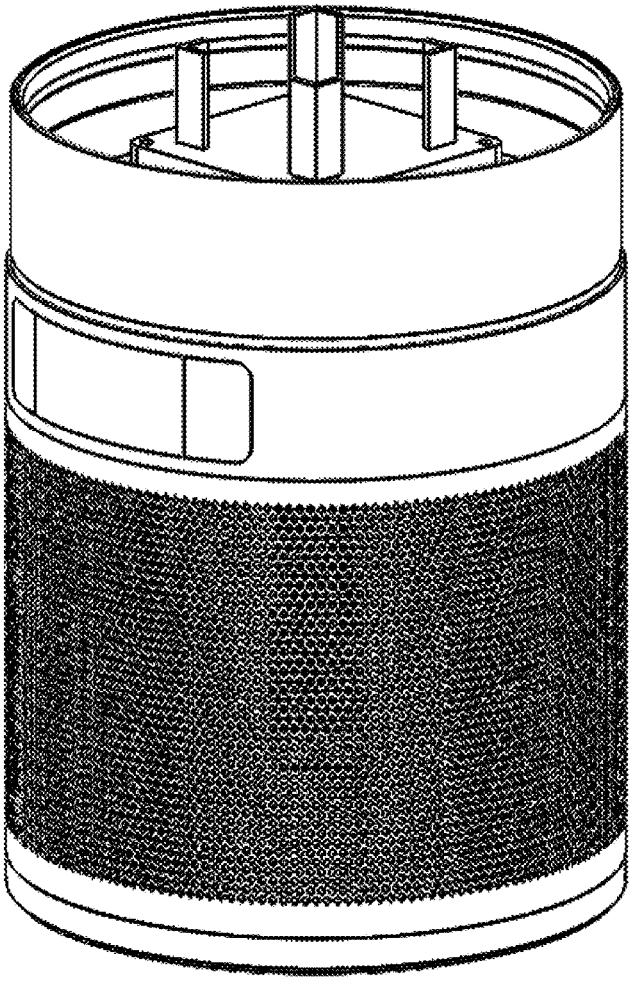
FIG. 9 illustrates an example assembled grill assembly, according to some embodiments.

FIG. 8 illustrates an example portable-smart refrigerator grill assembly 800, according to some embodiments. Portable-smart refrigerator grill assembly 800 includes pump bracket 802. Portable-smart refrigerator grill assembly 800 includes top base 804. Top base 804 holds pump bracket 802. Portable-smart refrigerator grill assembly 800 includes middle base 806. Portable-smart refrigerator grill assembly 800 includes bottom base 808. Bottom base 808 includes a silicone seal. Pump bracket 802, middle base 806, bottom base 808 can be an ABS material. Top base 804 can be a PP material. Grill exterior 104 is provided as an exterior of an assembled of portable-smart refrigerator grill assembly 800. A bottom base 810 that comprises a silicone seal on a bottom side of the bottom base 810 is also included. FIG. 9 illustrates an example assembled grill assembly 900, according to some embodiments.

Figure 10:
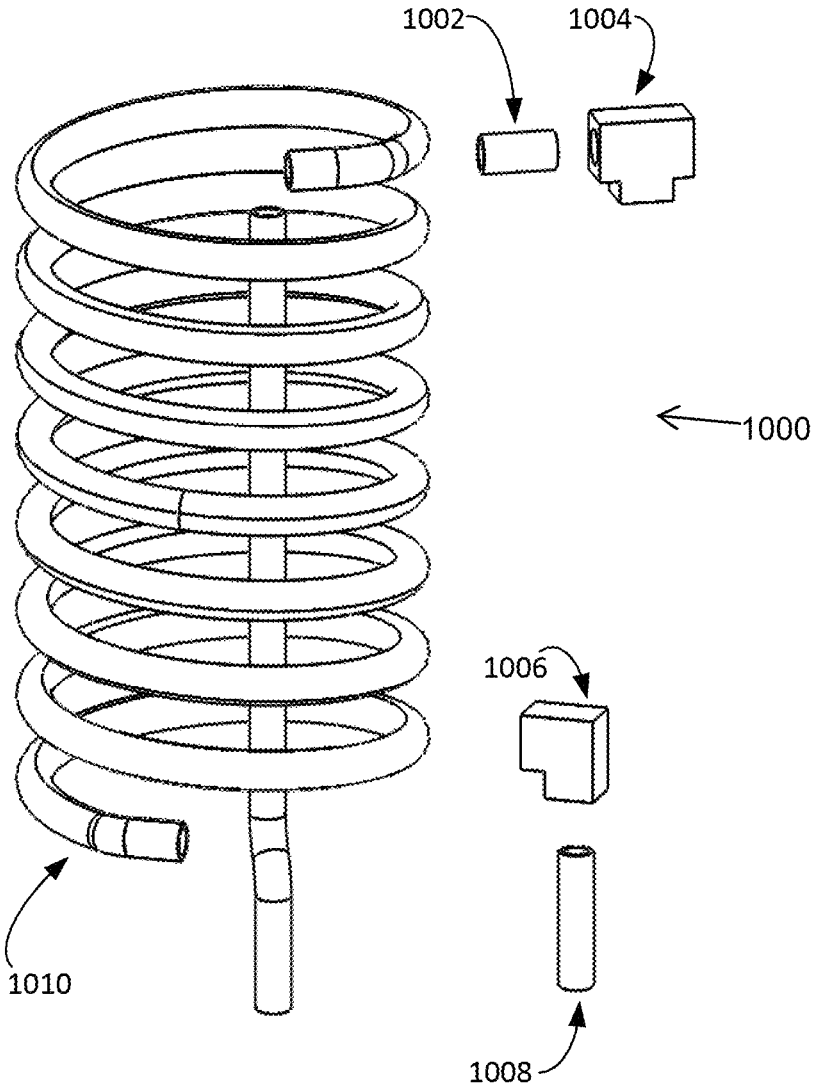
FIG. 10 illustrates an example portable-smart refrigerator cooling-coil assembly, according to some embodiments.

FIG. 10 illustrates an example portable-smart refrigerator cooling-coil assembly 1000, according to some embodiments. Portable-smart refrigerator cooling-coil assembly 1000 includes feeding tube 1002. Portable-smart refrigerator cooling-coil assembly 1000 includes top elbow 1004. Top elbow 1004 can elbow is installed between two lengths of tubing/pipe to allow a change of direction. Portable-smart refrigerator cooling-coil assembly 1000 includes bottom elbow 1006. Top elbow 1004 and bottom elbow 1006 can be made of copper. Portable-smart refrigerator cooling-coil assembly 1000 includes bottom tube 1008. Portable-smart refrigerator cooling-coil assembly 1000 includes cooling coil 1010. Portable-smart refrigerator cooling-coil assembly 1000 includes vertical tube 1012. The tube/pipes of portable-smart refrigerator cooling-coil assembly 1000 can be made of copper, in some example embodiments. For example, copper tubing can be of 8 mm outer/6 mm inner D. An assembled version 1014 of portable-smart refrigerator cooling-coil assembly 1000 is also shown.

Figure 11A:
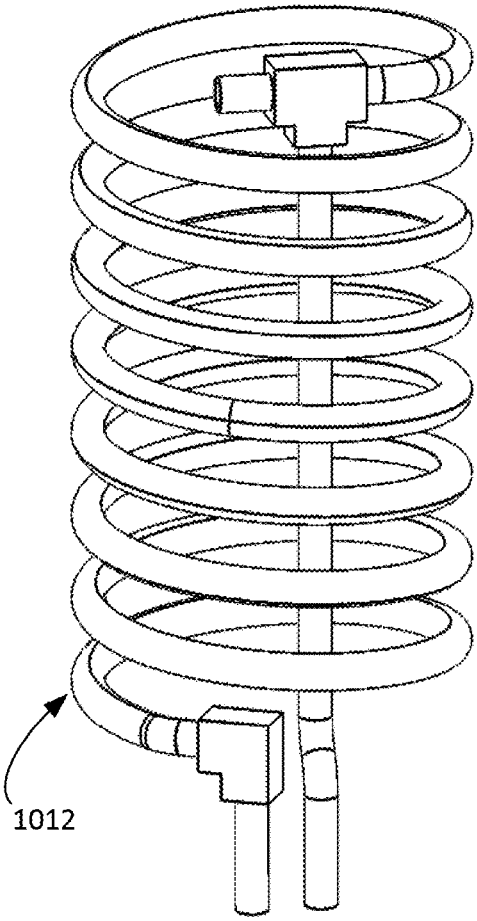
FIGS. 11A-B illustrate an example portable-smart refrigerator cooling-coil assembly, according to some embodiments.
Figure 11B:
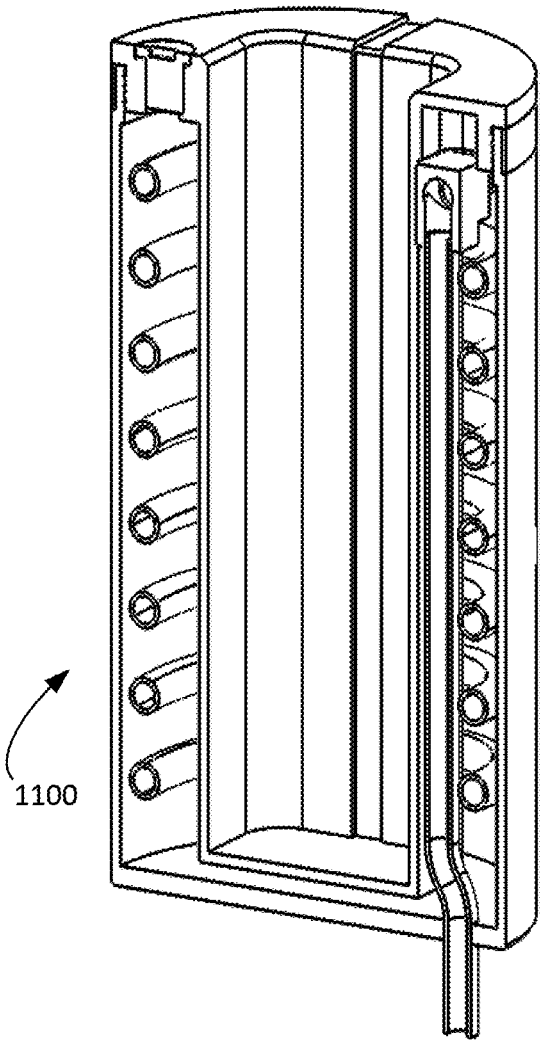

FIGS. 11A-B illustrate an example portable-smart refrigerator cooling-coil assembly 1000, according to some embodiments. FIG. 11A illustrates soldering of top elbow 1004 and bottom elbow 1006 to cooling coil 1010, according to some embodiments. FIG. 11 B illustrates a cross section view of portable-smart refrigerator cooling-coil assembly 1000 installed into a PCM chamber, according to some embodiments.

Figure 12:
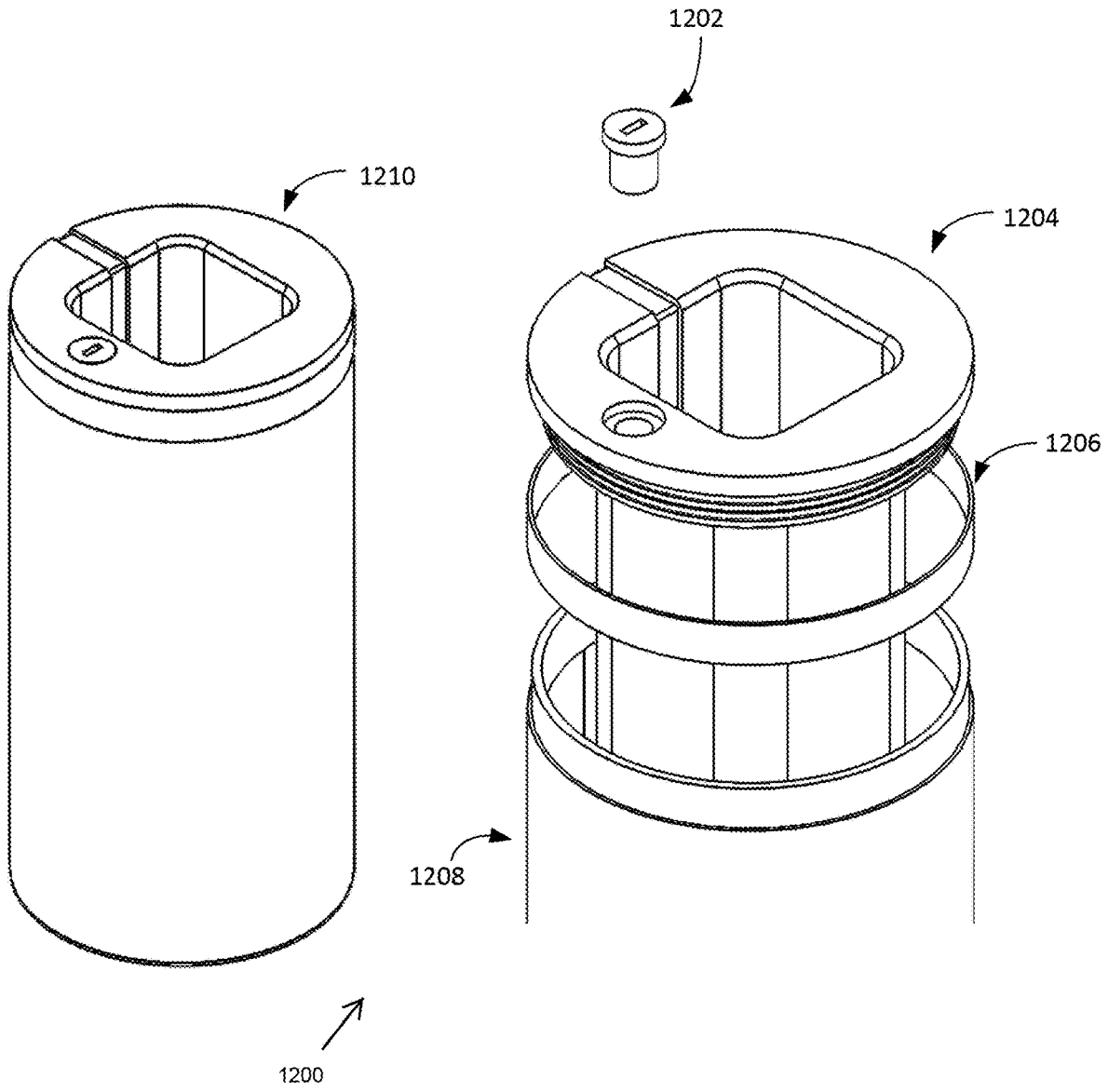
FIG. 12 illustrates an example portable-smart refrigerator PCM chamber assembly, according to some embodiments.

FIG. 12 illustrates an example portable-smart refrigerator PCM chamber assembly 1200, according to some embodiments. Portable-smart refrigerator PCM chamber assembly 1200 includes cork 1202. Cork 1202 can be made of HDPE material. Portable-smart refrigerator PCM chamber assembly 1200 includes top material of PCM chamber 1204. Top material of PCM chamber 1204 can be made of HDPE material. Portable-smart refrigerator PCM chamber assembly 1200 includes compression ring 1206 can be stainless steel. Compression ring 1206 is metal seals that fits between the portable-smart refrigerator PCM chamber and smart-fridge cylinder. Compression ring 1206 fits into a groove around the outer diameter of portable-smart refrigerator PCM chamber. Portable-smart refrigerator PCM chamber assembly 1200 includes bottom material portion of PCM chamber 1208. The bottom material portion of PCM chamber 1208 can be made of a HDPE material. The interfaces between coils and plastic apertures/openings can include water-tight sealants. An assembled version 1210 of portable-smart refrigerator PCM chamber assembly 1200 is also shown.

Figure 13:
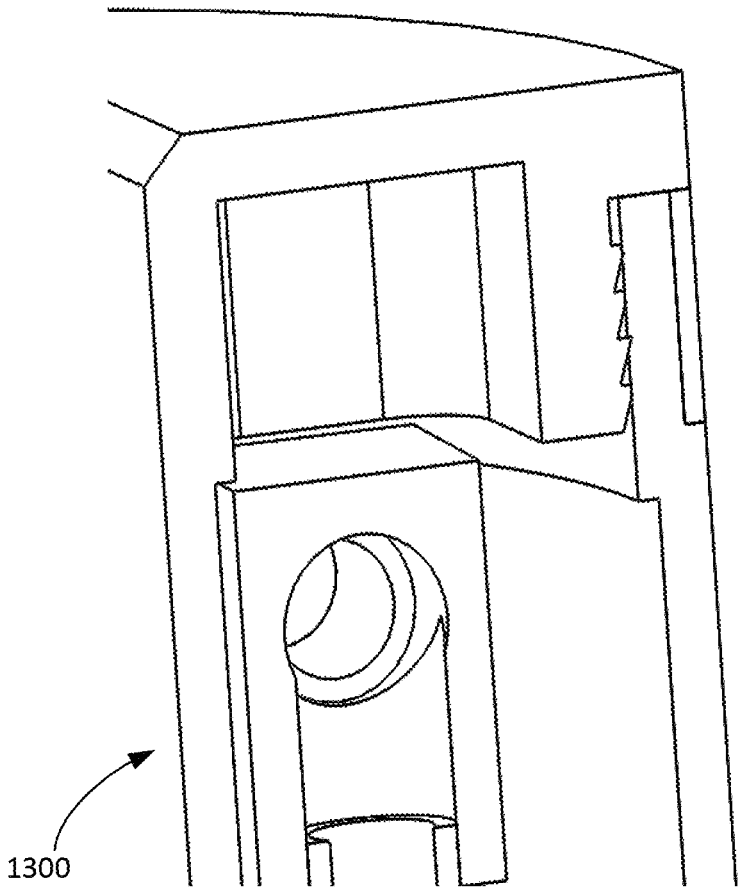
FIG. 13 illustrates another view of an example portable-smart refrigerator PCM chamber assembly, according to some embodiments.

FIG. 13 illustrates another view of an example portable-smart refrigerator PCM chamber assembly 1300, according to some embodiments. As shown, the cooling coil can be installed into the bottom part of the PCM chamber. The top part is then assembled using a press/interference fit 1302. In 1304, compression ring 1206 is used to prevent deformation in the press fit area.

Figure 14:
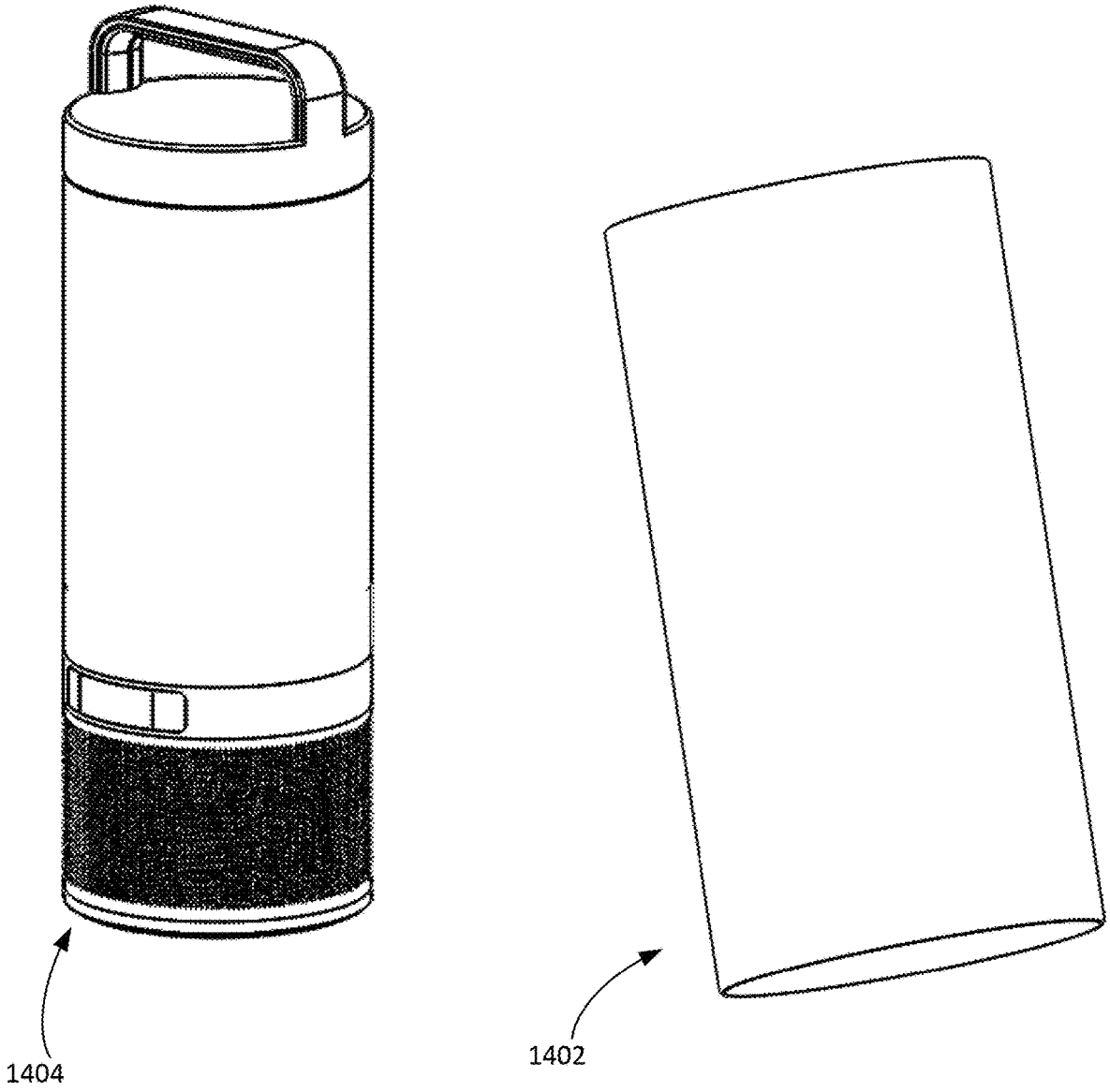
FIG. 14 illustrates an example portable-smart refrigerator sleeve assembly, according to some embodiments.

FIG. 14 illustrates an example portable-smart refrigerator sleeve assembly 1400, according to some embodiments. Portable-smart refrigerator sleeve assembly 1400 includes a fabric sleeve 1402. Fabric sleeve 1402 can be made of a stretchable material. An assembled version 1404 of portable-smart refrigerator sleeve assembly 1400 is also shown. Assembled version 1404 comprises an example image of portable-smart refrigerator 100.

Figure 15:
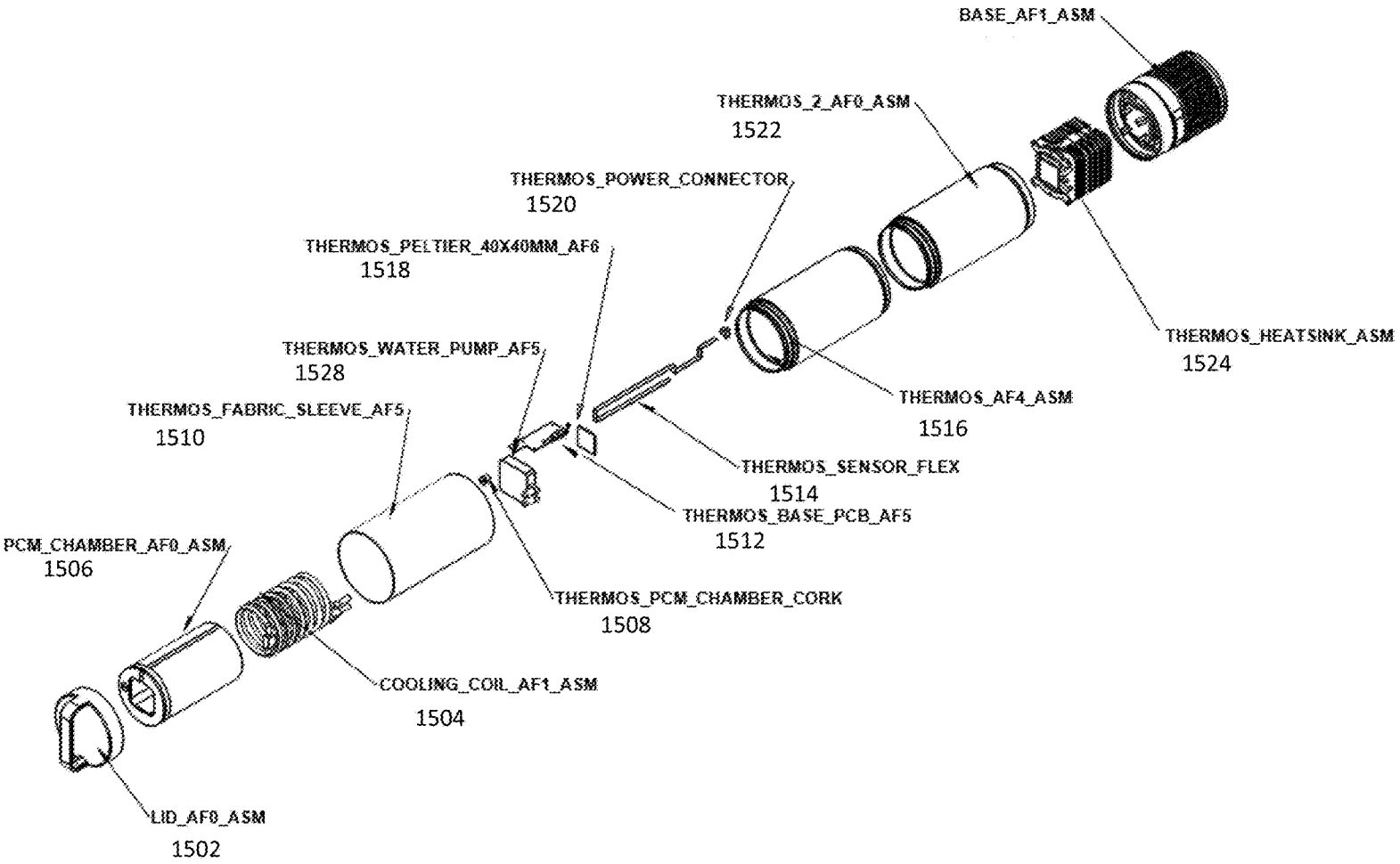
FIG. 15 illustrates an example exploded view of a portable-smart refrigerator assembly, according to some embodiments.

FIG. 15 illustrates an example exploded view 1500 of a portable-smart refrigerator assembly, according to some embodiments. Exploded view 1500 illustrates an example assembly of lid 1502, cooling coil 1504, PCM chamber 1506 (e.g. can be a Polypropylene chamber, etc.), thermos PCM chamber cork 1508, thermos fabric sleeve 1510, thermos water pump 1528, thermos base PCB 1512, thermos sensor flex 1514, thermos 1516, thermos Peltier 1518, thermos power connector 1520, thermos, 1522, thermos heat sink ASM 1524, base 1526, etc.

Figure 16:
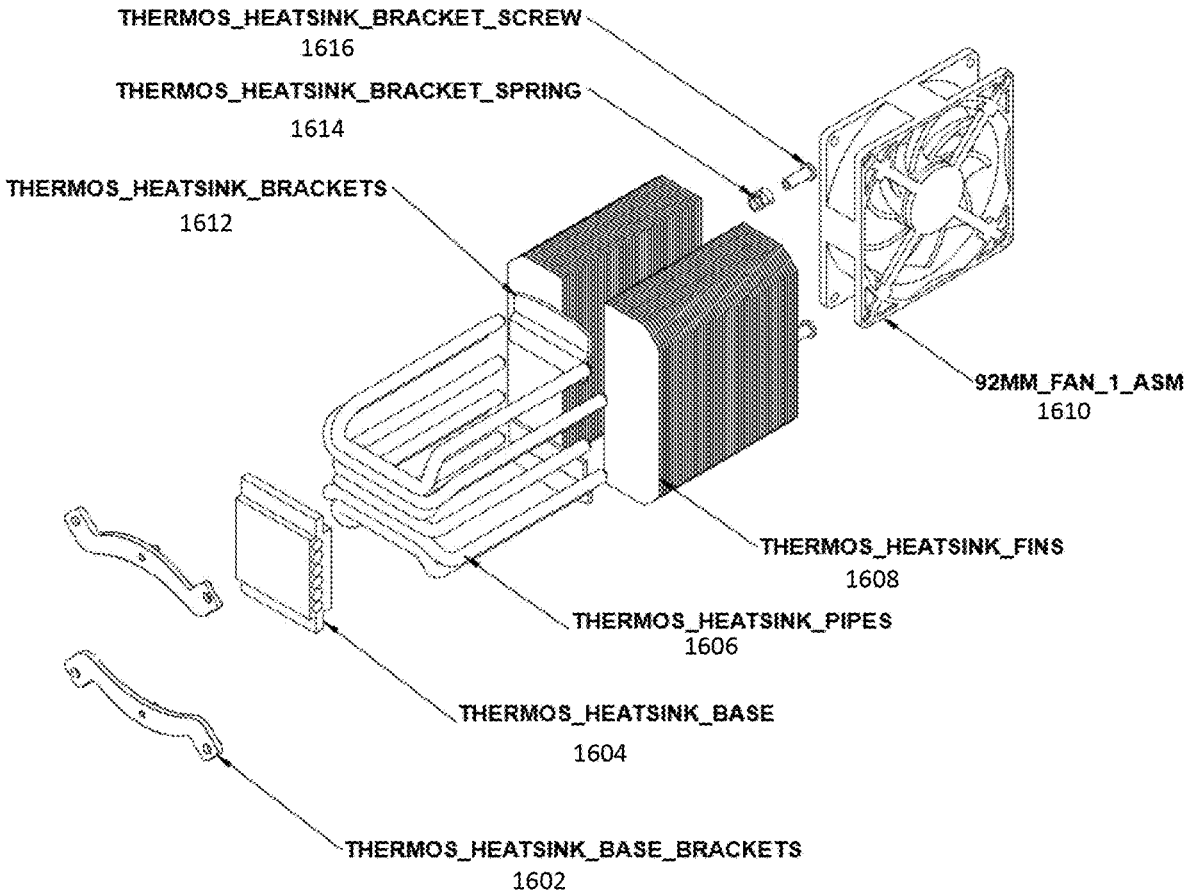
FIG. 16 illustrates an example exploded view of a portable-smart refrigerator heat seat system, according to some embodiments.

FIG. 16 illustrates an example exploded view of a portable-smart refrigerator heat seat system 1600, according to some embodiments. Thermos heat sink base brackets 1602, thermos heat sink base 1604, thermos heat sink pipes 1606, thermos heat sink fins 1608, fan 1610, thermos heat sink brackets 1612, thermos heat sink bracket spring 1614 and thermos heat sink bracket screw 1616.

Figure 17:
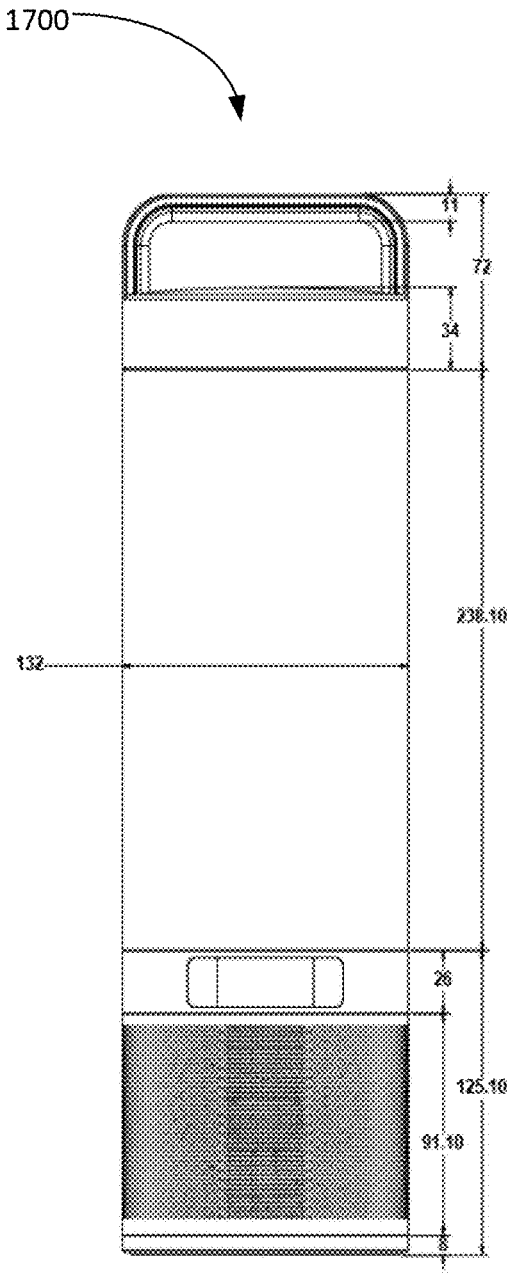
FIG. 17 illustrates an example view of a portable-smart refrigerator assembly, according to some embodiments.

FIG. 17 illustrates an example view 1700 of a portable-smart refrigerator assembly, according to some embodiments. Example view 1700 illustrates an example set of dimension measurements in terms of millimeters. This example is provided by way of illustration and not of limitation.

Figure 18:
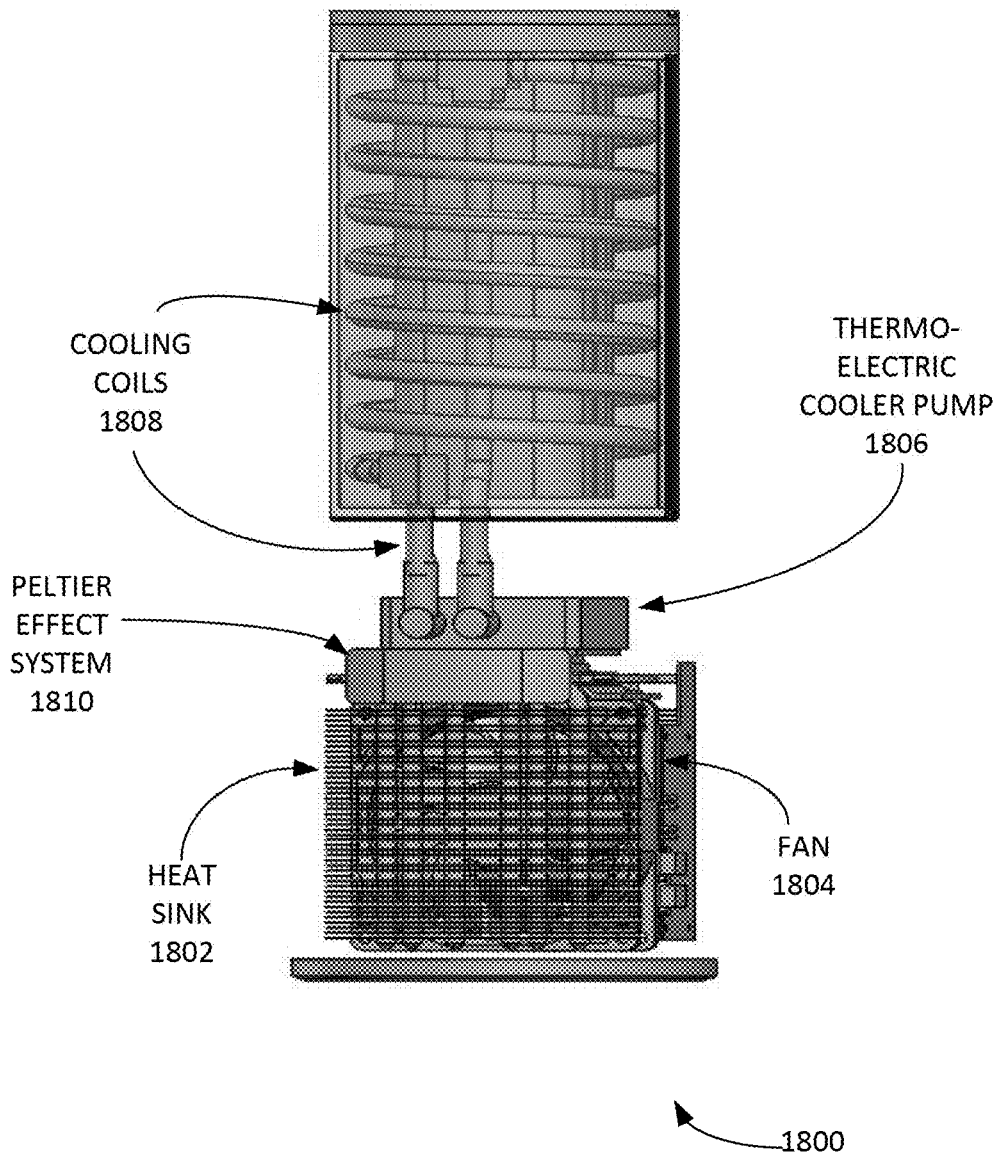
FIG. 18 illustrates an example interior view of a pump/coil/heat sink assembly, according to some embodiments.

FIG. 18 illustrates an example interior view of a pump/coil/heat sink assembly 1800, according to some embodiments. Pump/coil/heat sink assembly 1800 includes heat sink 1802 coupled with fan 1804. Pump 1806 can be a thermo-electric cooler pump and pump a coolant through cooling coils 1808. In this way, portable-smart refrigerator assembly can be cooled and maintain a specified temperature range.

Example Computer Architecture and Systems

Figure 19:
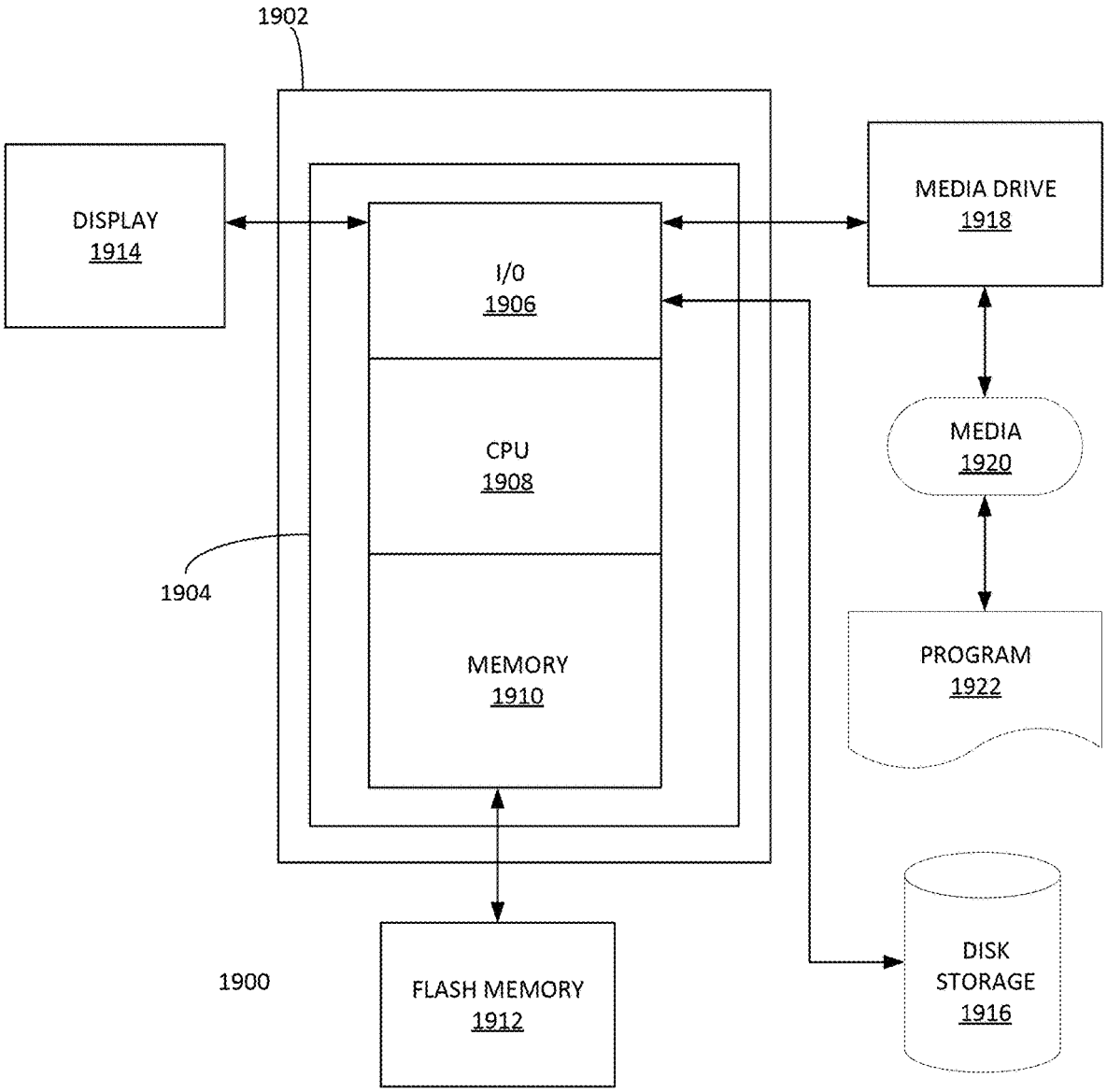
FIG. 19 is a block diagram of a sample computing environment that can be utilized to implement various embodiments.
Figure 20:
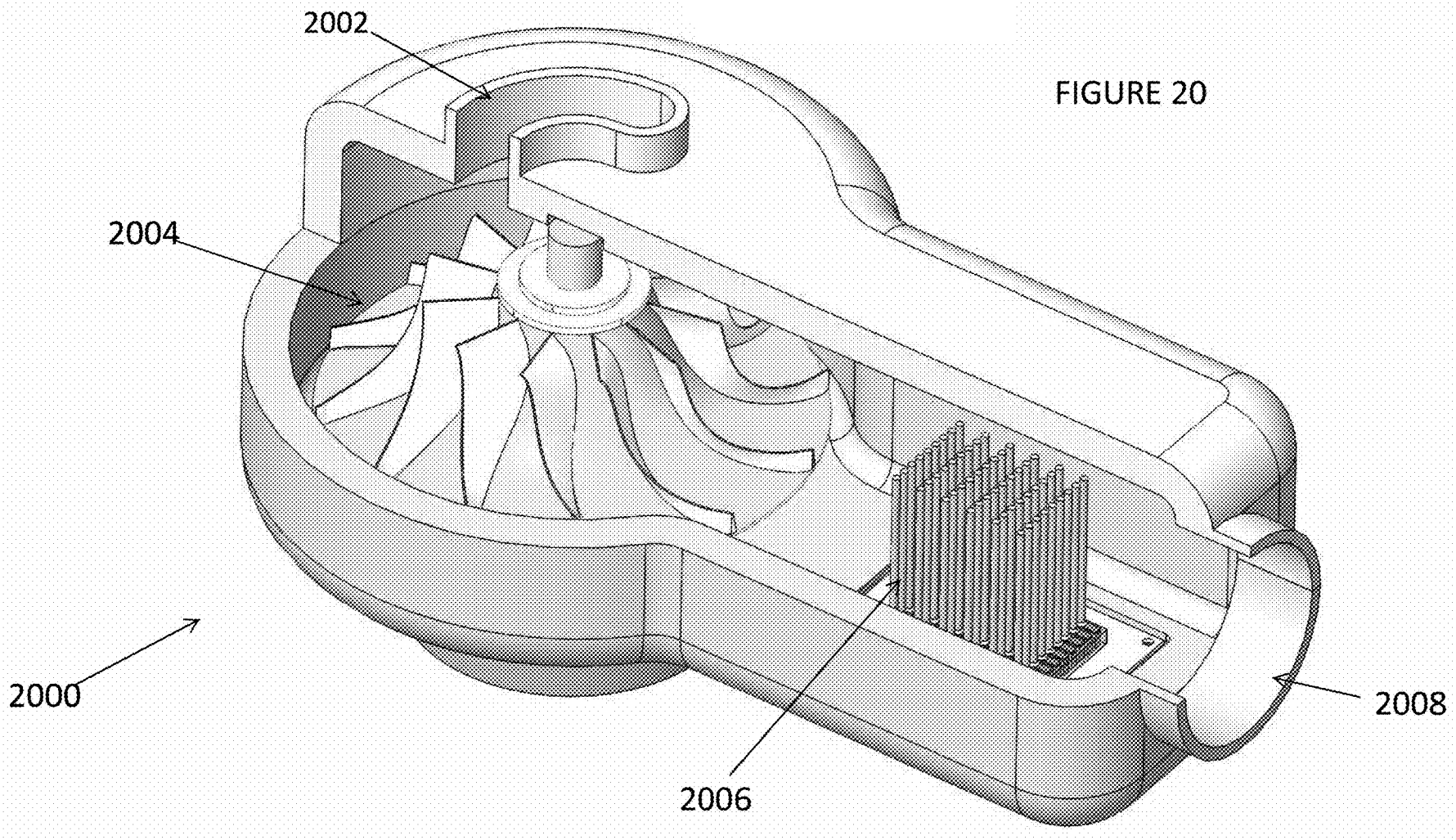
Figure 21:
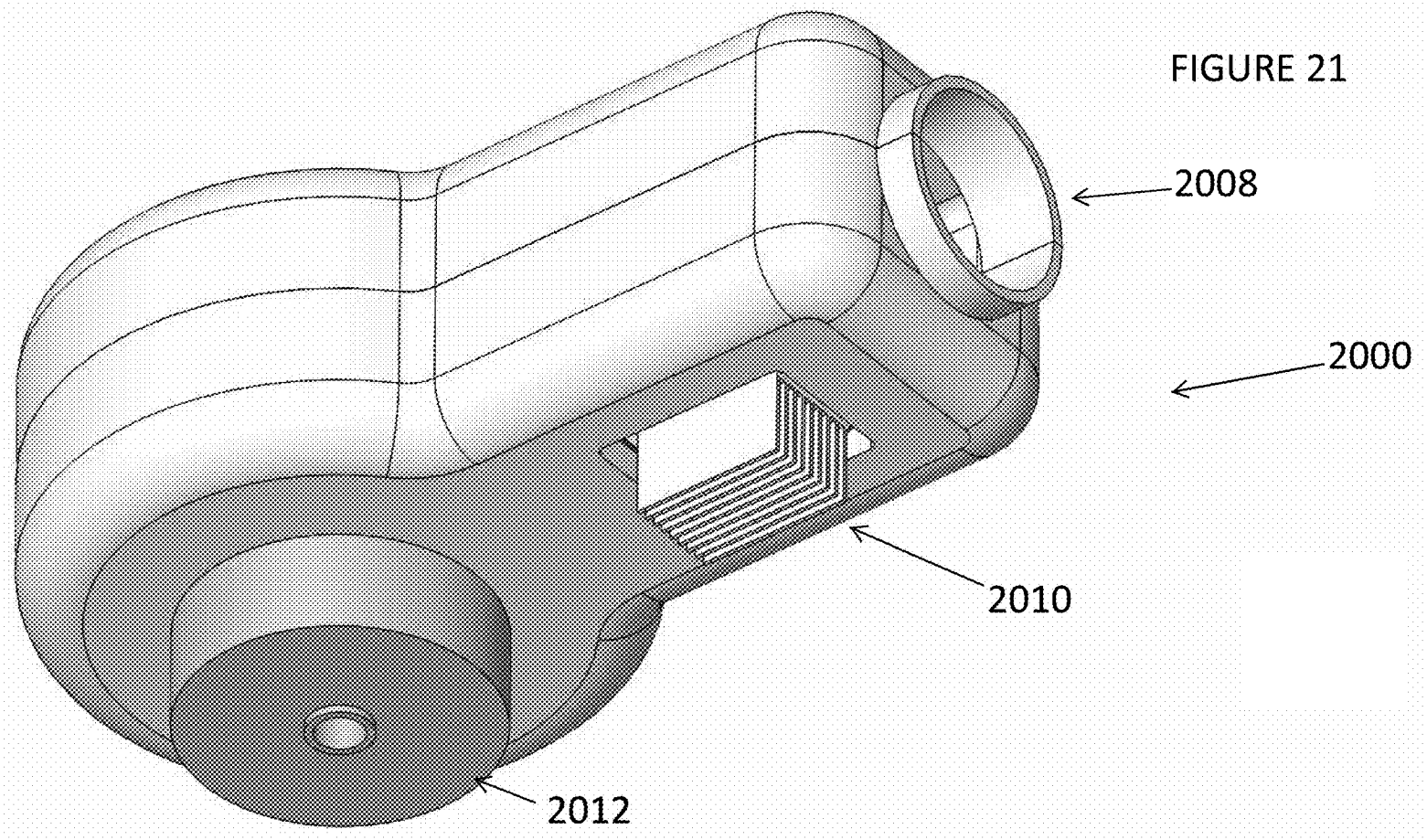
Figure 22:
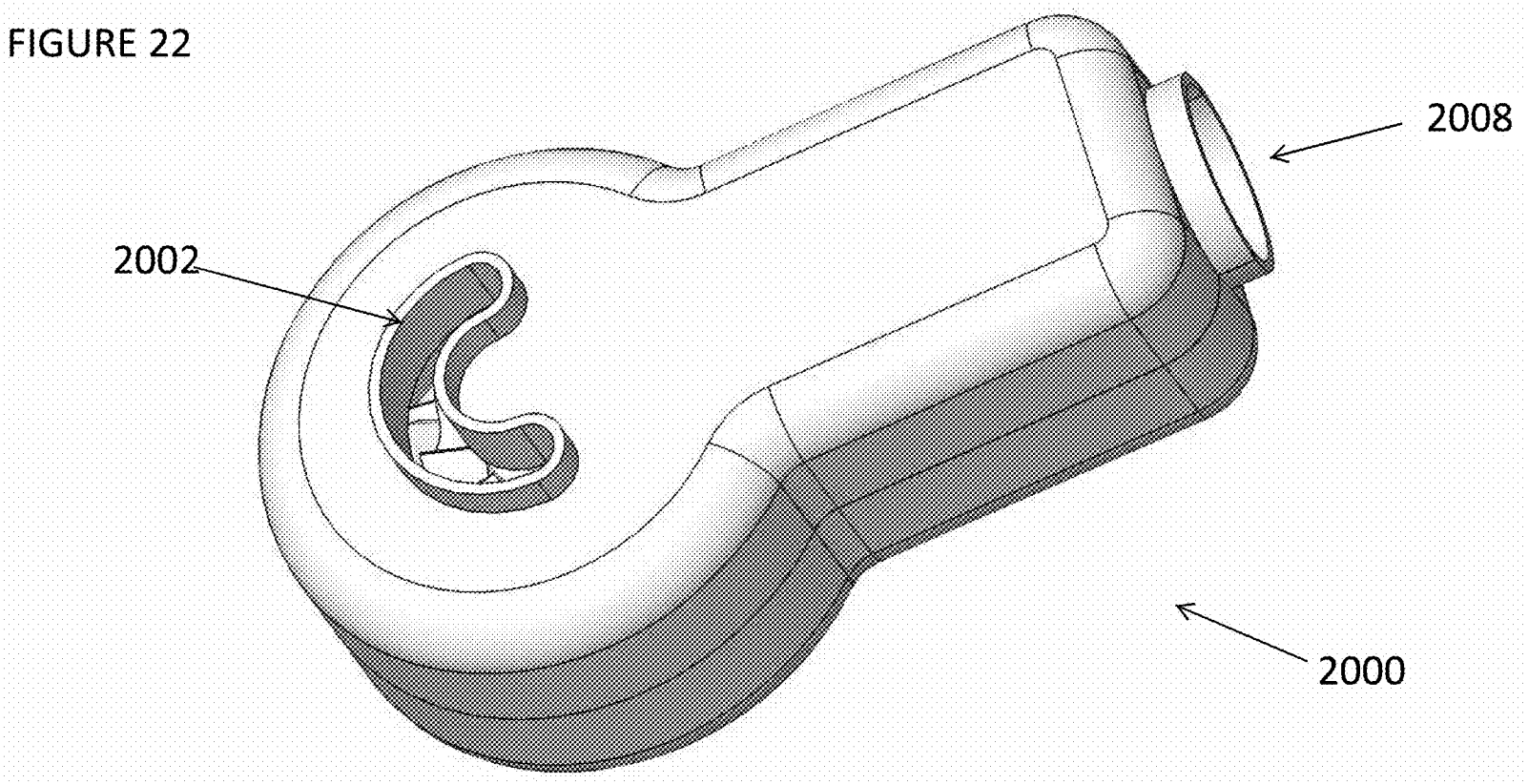
Figure 23:
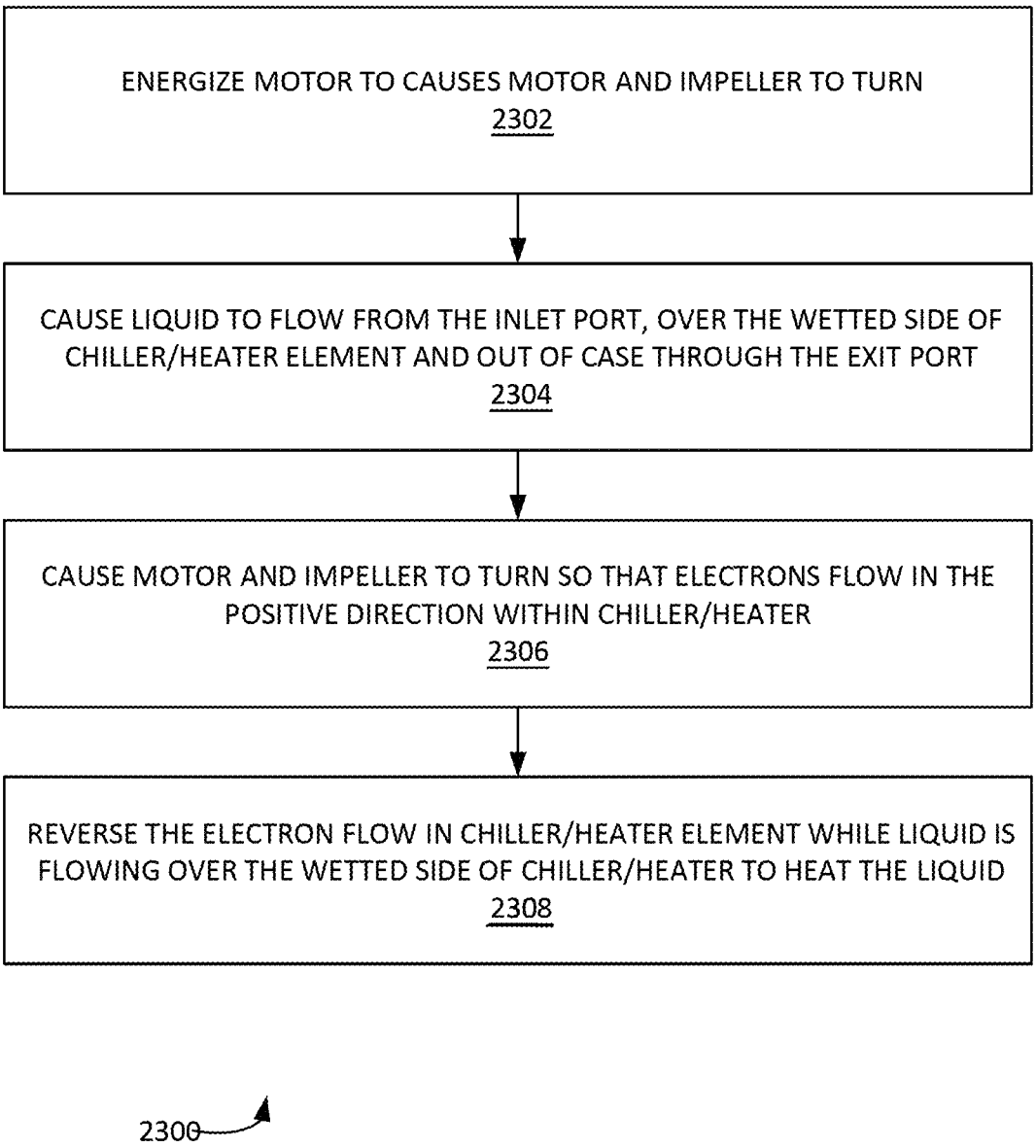

FIG. 19 depicts an exemplary computing system 1900 that can be configured to perform any one of the processes provided herein. In this context, computing system 1900 may include, for example, a processor, memory, storage, and I/O devices (e.g., monitor, keyboard, disk drive, Internet connection, etc.). However, computing system 1900 may include circuitry or other specialized hardware for carrying out some or all aspects of the processes. In some operational settings, computing system 1900 may be configured as a system that includes one or more units, each of which is configured to carry out some aspects of the processes either in software, hardware, or some combination thereof.

FIG. 19 depicts computing system 1900 with a number of components that may be used to perform any of the processes described herein. The main system 1902 includes a motherboard 1904 having an I/O section 1906, one or more central processing units (CPU) 1908, and a memory section 1910, which may have a flash memory card 1912 related to it. The I/O section 1906 can be connected to a display 1914, a keyboard and/or other user input (not shown), a disk storage unit 1916, and a media drive unit 1918. The media drive unit 1918 can read/write a computer-readable medium 1920, which can contain programs 1922 and/or data. Computing system 1900 can include a web browser. Moreover, it is noted that computing system 1900 can be configured to include additional systems in order to fulfill various functionalities. Computing system 1900 can communicate with other computing devices based on various computer communication protocols such a Wi-Fi, Bluetooth® (and/or other standards for exchanging data over short distances includes those using short-wavelength radio transmissions), USB, Ethernet, cellular, an ultrasonic local area communication protocol, etc.

The portable smart refrigerator can include a thermo-electric cooler pump as provided in U.S. patent application Ser. No. 16/523,827, titled THERMO-ELECTRIC COOLER PUMP METHODS AND SYSTEMS and filed on 26 Jul. 2019, which is incorporated herein by reference in its entirety. Thermo-electric cooler pump (not shown) includes a liquid pump with integrated chiller and heater. This liquid can be pushed through coiling assembly. The liquid pump with integrated chiller includes four components. The case component seals the liquid so that the liquid does not escape except by the inlet port and exit port which are also formed by case.

The motor component situated outside of the case, is not wetted by the liquid, and is fixed to the Case by attachments such as screws. A shaft of the motor enters the case through a sealed hole.

The impeller is contained within the case. The impeller is wetted by the liquid. The impeller is attached to shaft such that the motion of motor is transferred to impeller causing it to move. The movement of impeller causes liquid to enter the inlet port and move toward the exit port. The movement of the liquid is directed from inlet to exit port by the geometry of case and impeller. The chiller/heater is fixed to the case by attachments such as screws. Chiller/Heater penetrates the case such that one part of chiller/heater is inside the case and is wetted by liquid while the other part of chiller/heater is outside of the case and is dry. There is a seal around chiller/heater so that liquid does not escape in the vicinity of the chiller/heater. Chiller/Heater converts electron flow to thermal heat transfer by means of the Peltier effect. When electrons are made to flow in the positive direction, the wetted side of chiller/heater is driven to lower temperatures and the dry side to higher temperature. The Peltier effect causes heat to flow from cold side to hot side and is reversible with a reversal in electron flow.

Thermo-electric cooler pump can be managed by a computing system in the portable smart refrigerator. The computing system can be coupled with an exterior display. Exterior display can display various parameters (e.g. temperature, batter power, etc.) of the portable smart refrigerator. Computing system can also be coupled with various other systems such as, inter alia: temperature sensors, digital clocks, Wi-Fi systems, etc.

Conclusion

Although the present embodiments have been described with reference to specific example embodiments, various modifications and changes can be made to these embodiments without departing from the broader spirit and scope of the various embodiments. For example, the various devices, modules, etc. described herein can be enabled and operated using hardware circuitry, firmware, software or any combination of hardware, firmware, and software (e.g., embodied in a machine-readable medium).

In addition, it can be appreciated that the various operations, processes, and methods disclosed herein can be embodied in a machine-readable medium and/or a machine accessible medium compatible with a data processing system (e.g., a computer system), and can be performed in any order (e.g., including using means for achieving the various operations). Accordingly, the specification and drawings are to be regarded in an illustrative rather than a restrictive sense. In some embodiments, the machine-readable medium can be a non-transitory form of machine-readable medium.

What is claimed is:

1. A cylindrical portable refrigerator comprising:

a lid assembly comprising a lid coupled with a lid bottom cover for fastening the lid assembly to an internal upper portion of a PCM chamber assembly;

a grill assembly comprising a top base, a pump bracket, a middle base, a bottom base;

wherein the top based hold the pump bracket, wherein the top base is coupled with the middle base, and wherein the middle base is coupled with the bottom base;

a cooling-coil assembly comprising a feeding tube, a top elbow, a bottom tube, a cooling coil, wherein the top elbow is installed between the cooling coil and the feeding tube to enable a change of direction of a liquid and couples the feeding tube with the cooling coil, and wherein the cooling coil is coupled with the bottom tube;

a thermo-electric cooler pump comprising a liquid pump with a Peltier effect system, and wherein the thermo-electric cooler pump is coupled with the cooling coil, wherein the thermo-electric cooler pump comprises:

a chiller/heater component, wherein the chiller/heater component is fixed to the case component, and wherein the chiller/heater component penetrates the case component such that a portion of the chiller/heater component is inside the case component and is wetted by the liquid while the other part of chiller/heater component is outside of the case component and is dry, wherein there is a seal around the chiller/heater component so that liquid does not escape in a vicinity of the chiller/heater component, and wherein the chiller/heater component comprises an electron flow to a thermal heat transfer by means of the Peltier effect, wherein the thermo-electric cooler pump causes the liquid to flow from the inlet port, over the wetted side of chiller/heater component and out of case through the exit port;

wherein the chiller/heater component is energized so that electrons of the liquid flow in a positive direction to remove heat from the liquid, wherein the flow of the liquid is directed from the inlet port to the exit port by a specified geometry of the case component and the impeller component, wherein when electrons are made to flow in a positive direction within the chiller/heater component, a wetted side of the chiller/heater component is driven to lower temperatures and a dry side to a higher temperature, wherein when electrons are made to flow in a negative direction within the chiller/heater component, a wetted side of chiller/heater component is driven to higher temperatures and a dry side to the lower temperature, and wherein the wetted side of the chiller/heater component comprises a plurality of sets of regularly spaced and parallel elongated elements through which the liquid flows, wherein plurality of sets of regularly spaced and parallel elongated elements are placed in series along the traversal of the liquid;

the phase change material (PCM) chamber assembly that holds the cooling coil, wherein the PCM chamber is placed within an outer cylinder, and wherein a bottom portion of the PCM chamber assembly is coupled with the grill assembly, and wherein the PCM chamber assembly is plastered with a PCM material; and;

a sleeve assembly forming a portion of the outer cylinder, and wherein the cylindrical portable refrigerator includes a handle, wherein the PCM chamber assembly includes a compression ring comprising stainless steel that fits into a groove around the outer diameter of the PCM chamber, wherein the compression ring prevents deformation in a press fit area between a top portion and the bottom portion of the PCM chamber assembly.

* * * * *